US006579002B1

(12) United States Patent
Bartick et al.

(10) Patent No.: US 6,579,002 B1
(45) Date of Patent: Jun. 17, 2003

(54) BROAD-RANGE LARGE-LOAD FAST-OSCILLATING HIGH-PERFORMANCE RECIPROCATING PROGRAMMABLE LABORATORY SHAKER

(75) Inventors: Don A. Bartick, Ramona, CA (US); Bryan A. Bartick, Solana Beach, CA (US)

(73) Assignee: Qbiogene, Inc., Carlsbad, CA (US)

( * ) Notice: Subject to any disclaimer, the term of this patent is extended or adjusted under 35 U.S.C. 154(b) by 0 days.

(21) Appl. No.: 09/721,082

(22) Filed: Nov. 21, 2000

(51) Int. Cl.[7] ..... B01F 11/00

(52) U.S. Cl. ..... 366/112; 366/208; 366/212; 366/218; 366/240

(58) Field of Search ..... 366/108, 110, 366/111, 112, 116, 208, 210, 211, 212, 218, 237, 215, 240, 605, 601, 128

(56) References Cited

U.S. PATENT DOCUMENTS

| | | | | | |
|---|---|---|---|---|---|
| 735,209 | A | * | 8/1903 | Carnochan | 366/110 |
| 991,381 | A | * | 5/1911 | Simmers | 366/111 |
| 1,530,212 | A | * | 3/1925 | Solon | 366/240 |
| 1,595,255 | A | * | 8/1926 | Smith | 366/112 |
| 1,607,811 | A | * | 11/1926 | Blum | 366/110 |
| 1,947,398 | A | * | 2/1934 | Stuhler | 366/111 |
| 1,968,711 | A | * | 7/1934 | Savy | 366/111 |
| 2,022,526 | A | * | 11/1935 | Schletz | 366/211 |
| 2,022,527 | A | * | 11/1935 | Schletz | 366/605 |
| 2,161,134 | A | * | 6/1939 | Chapman | 366/111 |
| 2,251,447 | A | * | 8/1941 | Gelbman et al. | 366/111 |
| 2,397,695 | A | * | 4/1946 | Schutt | 366/111 |
| 3,640,508 | A | * | 2/1972 | Reibig | 366/116 |
| 4,316,672 | A | * | 2/1982 | Kerscher | 366/110 |
| 4,619,532 | A | * | 10/1986 | Schmidt, III | 366/110 |
| 5,060,151 | A | * | 10/1991 | Mikyska et al. | 366/208 |
| 5,375,927 | A | * | 12/1994 | Hermsen et al. | 366/208 |

* cited by examiner

*Primary Examiner*—Tony G. Soohoo
(74) *Attorney, Agent, or Firm*—Fuess & Davidenas

(57) ABSTRACT

A reciprocating laboratory shaker with multiple force cancellations to reduce vibration and noise while permitting, typically, oscillations ranging to ¾" peak-to-peak at speeds ranging to 6000 cpm with sample loads ranging to one pound (1 lb.) for shaking durations ranging to at least five minutes (5 min.), so as to liquify and break down cells in mixtures of biological samples and ceramic beads. The shaker has a frame; a motor with a double-ended shaft; a statically- and dynamically-balanced crankshaft at each shaft end, the two crankshafts having 180° phase difference; and two pistons, each of which is constrained for linearly reciprocating movement and connected by an associated linkage to an associated crankshaft. Engagement features on each piston engage and retain diverse jig fixtures holding samples for shaking. A jig fixture has a grid array holder holding sample containers, a box holding the array holder, and a space frame, which may be integrated with the box, holding and clamping shut the box while mounting to the piston.

8 Claims, 12 Drawing Sheets

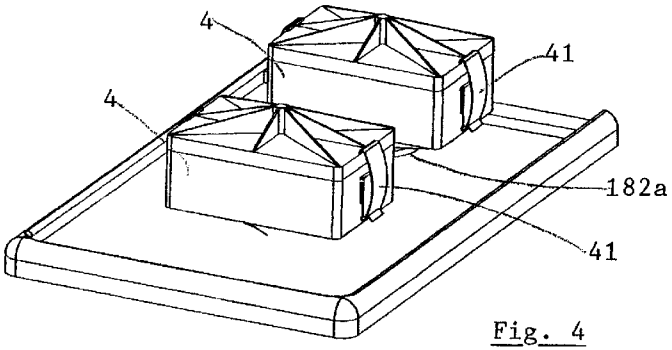
Fig. 4
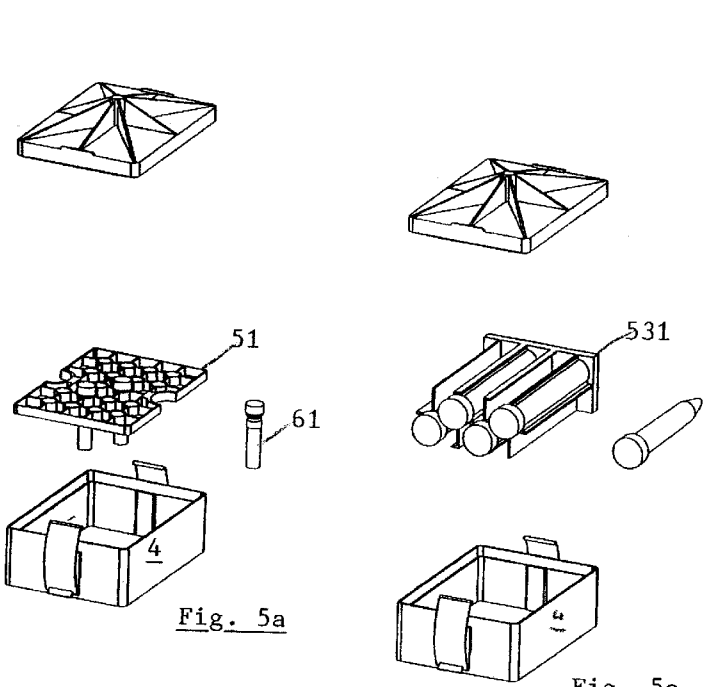
Fig. 5a
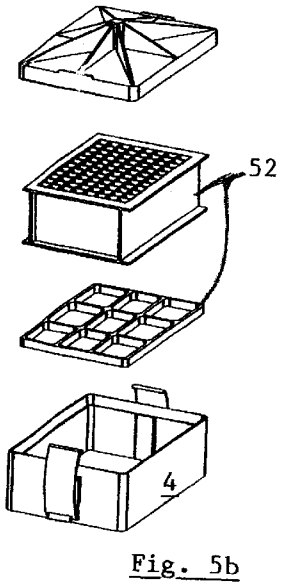
Fig. 5b
Fig. 5c
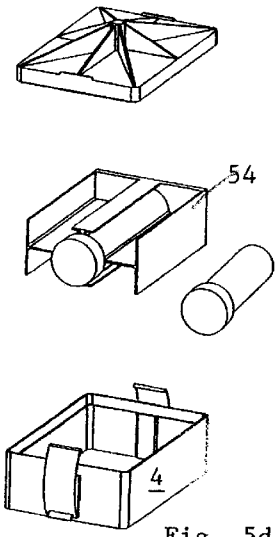
Fig. 5d

BROAD-RANGE LARGE-LOAD FAST-OSCILLATING HIGH-PERFORMANCE RECIPROCATING PROGRAMMABLE LABORATORY SHAKER

BACKGROUND OF THE INVENTION

1. Field of the Invention

The present invention generally concerns shakers, and laboratory shakers.

The present invention particularly concerns a laboratory shaker that is high performance in each of (i) shaking rate, (ii) shaking amplitude, (iii) load capacity, (iv) versatility in the amount, weight, numbers and sizes of containers and samples that are shaken, (v) overall compactness, (vi) durability, (vii) quietness and lack of vibration in operation, and (vii) programmability.

2. Description of the Prior Art 2.1 General Description of the State of the Laboratory Shaker Art The cost of laboratory space, and efficiencies of human access and use, dictate that laboratory equipments, including shakers, should be compact and powerful, with a large load capacity, wherever and whenever possible. Moreover, shakers, in particular (along with stirrers, which have an overlapping function and purpose), may be called upon to handle a broad range of analysis protocols, and of biological samples. For example, as well as performing common shaking at, most typically, several tens of hundreds of cycles per minute, new and increasingly popular laboratory protocols call for biological materials to be mixed with ceramic beads and then shaken, preferably at many thousands of oscillations per minute, until cellular and sub-cellular structures are completely obliterated, loosing the biological constituent components, including genetic components, of the materials into a sort of biological broth, or stew.

Present-day (circa 2000) laboratory shakers that are capable of shaking samples, such as biological samples, at high, multi-thousand cycle per minute (cpm) rates typically have low load capacities, on the order of less than one ounce (1 oz.) Conversely, those shakers that have broad and ample load ranges (1–8 oz.) are often capable of performing shaking at but low speeds, a only some few tens or hundreds of cycles per minute (cpm). There is, however, no systemic difference in the amount of material to be shaken between the high-speed and low-speed shaking protocols: it is quite common to wish to shake many ounces at high speed.

The reason that present laboratory shakers are limited in shaking at high speeds such loads as are common is not the required energy for shaking. Many shakers have large fractional horsepower motors that should be able to develop the forces to shake and propel samples weighing several ounces at high oscillatory speeds. However, the bearings of most motors will not directly withstand the inertial forces of shaking, which requires mechanical isolation of the shaking motion from the motor drive. This mechanical isolation, and the shaking itself, produces prodigious vibration and noise. Unless the shakers are strongly anchored to extremely large and massive structures, most preferably to the steel frames of steel-frame buildings, they tend to produce abominable noise and vibration. If and when the shakers are "tuned" for reduction of certain harmonics then they tend to have a limited operational ranges in both (i) permissible load, and (ii) shaking speed, and become all but unusable outside these ranges. And, when the shakers are anchored firmly to earth then huge forces are applied to the bearings of the shaker, making that the shaker must itself be massive to withstand the forces that it produces.

Accordingly, it would be useful if some approach existed to "finesse" the operational and structural problems of the traditional laboratory shaker, and if it were somehow to be possible build a compact and economical broad-range high-performance shaker in which the considerable forces of shaking did not translate into large mass for the shaker, vibration and noise.

In another area, the slower-paced era wherein laboratory samples that required shaking could be manually transferred into containers, mostly glassware and most commonly test tubes, that could be physically accommodated by the shaker is now past. Most modern shakers make some effort to accommodate such a range of sample containers as the manufacture of the shaker envisions will be in use by purchasers of the shaker. However, no manufacturer, or purchaser, can foresee every eventuality, and the sample containers that are, or become, required by certain laboratory equipments may turn out to be unsuitable for use with the shakers of the same laboratory, or of other laboratories. It would thus be useful if some sort of shaking system could be derived where the mechanized operation of the shaker was to some degree separated from the packaging of the samples shaken, perhaps by providing some sort of jig by which various sample packages, and new-type sample packages not even in existence when the shaker was built, could be conveniently adopted to the shaker.

Of course, a jig presents its own problems. Its mass must be added to that of the samples, and sample containers, as the load experienced by the shaker. Accordingly, the jig should be lightweight. However, if must also be strong to withstand the inertial forces of shaking. It would be useful if the manner of attachment of the jig to the shaker could somehow support of such a "strong but light" jig construction.

A great proliferation of different jigs also presents its own cost, management and usage problems. When every different sample container requires its own special jig then the procurement cost, and cost of use, of (i) adapting the sample containers to the shaker through one or more jigs may rival the cost of (ii) directly adapting the sample containers to the shaker by transferring samples in incompatible containers into compatible containers. Accordingly, it would be useful if some limited number of jigs, or types of jigs, as are envisioned for use with a standard shaker could show both (i) widespread compatibility with existing laboratory sample containers and (ii) good potential for successful adaption to types of sample containers that may not even yet exist.

Finally, the shaker is currently one of the "dumbest" instruments in the laboratory. It is untenable that a human must set and re-set multiple speed and duration parameters for common shaking tasks that are regularly repetitively performed. The task is time-consuming and onerous, especially when a shaking protocol is bifurcated, with, most typically, so many minutes at one speed and then so many minutes at another speed, making that a human must stand by the shaker. If a human is charged to often set and re-set parameters then errors may occur. It would be useful if the shaker could be programmed but once for certain standard shaking protocols in use in the laboratory, and could thereafter re-create these protocols at the "touch of a button".

2.2 Specific Previous Laboratory Shakers and Specimen Holders of Relevance to the Present Invention A laboratory shaker of traditional form for use in general laboratory testing and analysis is shown in U.S. Pat. No. 5,167,928 to Kelly, et. al. for a LABORATORY SHAKER APPARATUS. The apparatus comprises a base that is reciprocally movable relative to a sub-base. A frame is mounted to the base and includes spaced apart vertical supports with a horizontal support assembly rotatably mounted therebetween. A number of test vessels are mounted to the horizontal support assembly and can be rotated with the horizontal support assembly 180° relative to the base. The vessels may be subjected to simultaneous shaking for identical periods of time. The horizontal frame assembly to which the vessels are mounted can be inverted between adjacent periods of shaking to permit selected refilling of the vessels, escape of gases therefrom and drainage of material from the vessels.

Another shaker of this form—this time with a more complex motion—is shown in U.S. Pat. No. 4,345,843 to Berglund, et. al. for an AGITATOR.

Finally, the present invention will be seen to perform shaking on test tubes that are held in racks. A test tube rack holder for supporting a test tube rack on a rotary shaker is shown in U.S. Pat. No. 4,770,381 to Gold for a TEST TUBE RACK HOLDER.

A particular commercial laboratory shaker that may usefully be compared with the shaker of the present invention is made by Savant Instruments, Inc. of Holbrook, N.Y., and sold by the assignee of the present invention, Q-Biogene of Carlsbad, Calif. The existing shaker is capable of the same high 6,000 oscillations per minute which will be seen to be the nominal maximum speed of the shaker of the present invention. However, its load capacity is only eight 2-milliliter (2 ml.) test tubes, or about 1/7 of an ounce sample weight, at that speed. The shaker of the present invention will be seen to hold about sixteen times (×16) as much. The peak-to-peak amplitude of the Savant shaker is about 0.625 inches (5/8"), whereas the peak-to-peak amplitude of the shaker of the present invention will be seen to be 0.750 inches (3/4") Moreover, the shaker of the present invention will be seen to mount a plethora of different containers, and to perform its shaking function with much less vibration and noise.

2.3 Previous Laboratory Protocols Including Shaking

The shaker of the present invention will be seen to be suitable to perform virtually all presently-known, circa 2000, laboratory protocols that call for shaking. The shaker is in particular suitable to perform the protocol of U.S. Pat. No. 5,643,767 to Fischetti and Cheung for a PROCESS FOR ISOLATING CELLULAR COMPONENTS.

In the Fischetti and Cheung process a particular reagent, method and container permits the isolation of cellular components such as ribonucleic acid (RNA) from cells in a liquid solution. The container includes a cover assembly and a holder which is normally closed by the cover assembly and contains an RNA extractant solvent, micron-sized particles and at least one larger particle suitably of millimeter size. The container contains the reagent, which is an extractant solvent which contains phenol and guanidinium thiocyanate or guanidinium chloride and has a pH of about 4. The container also includes a friable sealing layer which separates the extractant solvent from the liquid medium containing the cells until the container is reciprocally shaken. The method includes the reciprocal shaking of the container, wherein the larger particle breaks the friable layer to permit mixing of the liquid medium with the extractant solvent resulting in the breaking of the cell walls by the micron-size beads and the release of the RNA.

SUMMARY OF THE INVENTION

The present invention contemplates a broad-range high-load fast-oscillating high-performance reciprocating programmable laboratory shaker directed to consistently reliably shaking usefully large amounts of samples, normally biological specimens, contained within variable numbers of diverse containers at controllably selected speeds and durations. Such shaking as may be programmably selected particularly permits, among other results, the agitation of a larger quantity of cells than heretofore at larger amplitudes than heretofore so strongly that the cell walls become broken, leaving cellular components and RNA in liberated solution, more quickly than heretofore.

The performance difference relative to previous shakers is one of kind as well as degree; comparable in nature and effect to high-speed whipping versus slow-speed stirring in a common kitchen blender. Nonetheless to its economical construction, the shaker of the present invention exhibits sufficiently high performance to reduce many slow and repetitive laboratory tasks previously involving the shaking of many small samples in small lots over half-hour, hour and longer periods into a single, quickly-performed, task of shaking all the samples together at high speed while a laboratory technician waits, most typically, only a few minutes or less.

The approach of the present invention to realizing such a high performance shaker is to counteract the inertial forces inevitably developed within the shaker, canceling wherever possible these forces with equal and opposite forces. Since the equal but opposite force cancellation occurring within the shaker is substantially independent of the (i) load and (ii) shaking speed, the shaker has (i) an unusually high load capacity, commonly ranging to sample(s) total weight(s) aggregating one pound (1 lb.) and more, and (ii) a broad operational range, typically ranging to some six thousand oscillatory cycles per minute (6,000 cpm). Such a (i) large load and (ii) high speed is unprecedented in an instrument of the modest size and cost of the preferred embodiment of a shaker in accordance with the present invention.

Additionally, the present invention contemplates versatile jigs each of which serves to efficiently adapt any number (up to a typically large maximum number) of a large number of different, and differently-sized, laboratory specimen containers to a standard shaker in accordance with the present invention. The jigs are versatile, as well as being lightweight and strong, because they use both (i) fitted inserts custom to the sample containers held and (ii) standard "box" enclosures that retain the fitted inserts, and held samples, by clamping force.

Finally, the present invention contemplates a programmable shaker where a large, unambiguous and ergonomic control panel permits that a technician may enter any desired shaking protocol (in terms of standard parameters such as the times and frequencies of multiple shaking and rest periods) but once, and may thereafter invoke this preprogrammed protocol by simply touching a push button function switch.

1. Performance of a Shaker in Accordance with the Present Invention

Commensurate with its use to pulverize diverse biological samples, the laboratory shaker of the present invention exhibits high performance in several different areas. The shaking rate is controllable from, typically, 300 cycles per minute (cpm) to a very high 6000 cpm. The shaking amplitude, even at higher cpm's, is typically at least one-half inch (1/2"), and is more typically three-quarters inch (3/4") peak-to-peak. The shaker will so perform without overheating or otherwise incurring any problems whatsoever for a minimum period of four minutes; which period suffices to pulverize all normal biological samples.

The shaker normally sets, unattached, upon a table or bench top. Even when fully loaded, the shaker imparts negliable vibration to the table or bench during operation—which has not always previously been the case with laboratory shakers. The airborne noise generated by the shaker is roughly equivalent to a kitchen blender, and is thus much better than average. The shaker has an indefinite operational lifetime that should extend, with periodic cleaning and lubrication, many years.

The preferred shaker mounts jigs that serve to hold various numbers of different, and differently-sized, containers of, most typically, biological samples. From one to several dozen samples that are shaken at one time may cumulate up to, most typically, some sixteen ounces (16 oz.), or one pound (1 lb.), in weight.

2. Theory of the Construction of a Shaker in Accordance with the Present Invention The preferred embodiment of a shaker in accordance with the present invention maximizes performance by the broad strategies of (i) symmetry, and (ii) simultaneously conducting two cyclic operations oppositely at a one hundred and eighty degree (180°) phase difference between the duplicate operations. These strategy (i) is applied once (in a comprehensive manner, incorporating many separate mechanical elements), but the strategy (ii) is applied two separate and distinct times. Thus the two strategies (i), (ii) taken together—and to the same purpose of producing high performance with low vibration and noise—are applied three separate times, and in three separate areas.

Both the (i) symmetry, and the (ii) simultaneous conduct of two sets of identical operations each at diametrically opposite phase, imparts such "force balance" to the shaker as compensates for the rapidly reciprocating motion of both (i) certain of the shaker's parts, and (ii) the shaker's load, and serves to greatly reduce noise and vibration.

The description of the mechanism in which these strategies are realized is as follows. In order to produce reciprocating motion of a specimen that is held within a container, the shaker of the present invention uses (i) a motor to turn (ii) a crankshaft to which is eccentrically affixed (iii) a linkage that connects to (iv) a piston attaching the container. Rotary motion induced in the crankshaft by the motor causes reciprocating linear motion in the piston affixing the specimen container, all as is substantially conventional. This mechanism, which is analogous to the like-named components of an internal combustion engine, is well-known as a basis of converting rotary motion into linearly reciprocating motion.

However, in accordance with the present invention, this classic mechanism is implemented with particular care to balance (insofar as is possible) the forces incurred during the shaking.

In accordance with a first aspect of the present invention—the application of symmetry—the entire shaker is based on equal but opposite structures, and shows substantial mirror symmetry. In particular, a motor of the shaker has a double-ended shaft which affixes an identical crankshaft at each shaft end. The mere existence of two, as opposed to one, complimentary crankshafts serves to minimize such vibration and bearing stress in the motor as would otherwise occur from driving an eccentric body at one end only of the motor's shaft.

A imaginary vertical plane that passes through the center of gravity of the shaker, and also of the shaker when fully loaded, passes substantially through the middle of the motor. Forces that are (i) equal but (ii) opposite at (iii) an equal moment arm of separation from this imaginary vertical plane—and how such particularly balanced forces might come to exist will be next discussed—may thus be considered to mechanically couple through the vertical middle of the motor, and of the shaker apparatus. This is exactly what is desired if the apparatus is to be left-right back-fore "balanced", and without any favored distribution of weight or of force.

In accordance with a separate and severable second aspect of the present invention, and the first application of the "equal but opposite" principle, each crankshaft and its associated connecting linkage and piston are both statically and dynamically balanced. Static balance is achieved by adding weight to the crankshaft equally and oppositely to that structure of the crankshaft that is used to attach the connecting linkage, and piston. By this addition of counterweight, an imaginary central axis of balance of the crankshaft remains aligned with the central axis of the shaft of the motor. The counter-weighing of the crankshaft is analogous to the well-known counterweight configuration of an oil well pump.

Dynamic balance is achieved by making that any combined inertial and gravitational moment of the rotating crankshaft perpendicular to the rotational axis of the crankshaft is everywhere equally opposite (not "everywhere equal", but "everywhere equally opposite"). Notably, this inertial moment measured at the point of the attachment of the connecting linkage includes a nominal load as well as the connecting linkage and piston. The load on each piston of the shaker is thus intentionally kept relatively constant, making that sample containers that hold scant lightweight samples—for example, a few microcapsules—are relatively heavy while those sample containers that hold heavy samples—for example a single large test tube containing nearly eight ounces of sample material—are relatively light: oppositely to what might be expected.

Both the static and dynamic crankshaft balance are hard to visually identify and recognize, including in the drawings of this specification of the preferred embodiment of a reciprocating shaker in accordance with the present invention. It is thus necessary to think about this balance: exactly what it is, where it is located, and what it accomplishes.

Consider that the way that this balance is realized is not the only possibility. It might be imagined, as a hypothetical illustration of the principles of the present invention, that nearly perfect static and dynamic balance would be realized, save for the operation of gravity, if there was to be an identical (i) connecting linkage, (ii) piston and (iii) sample container load hypothetically affixed to one crankshaft at a point one hundred and eighty degrees opposite to the existing affixation point. However, since the hypothetical two linkages would then mechanically interfere with each other, a crankshaft would then have be extended in the manner of the crankshaft for a multi-cylinder opposed-cylinder internal combustion engine. One linkage and piston would point up; one linkage and piston (on the extension of a single crankshaft) would go down. This geometry was actually tried. It was found, however, to be impractical to oppositely replicate the (i) connecting linkage, (ii) piston and (iii) sample container, and to shake a sample upside down.

It might alternatively be hypothesized that the linkages and pistons of an extended single crankshaft should be laid out horizontally, as is analogous to the opposed pistons within the horizontally-opposed internal combustion engines of the famous Volkswagon® Beetle or Porshe® 911. (Volkswagon and Porshe are registered trademarks of the respective companies). Alas, it not practical to obviate the effects of gravity by extending each of two (i) connecting linkages and (ii) pistons oppositely in the horizontal, and shaking the samples sideways. Accordingly, the crankshaft and associated parts are preferably dynamically balanced to run as smoothly as possible at some predetermined rotational speed and load, and are more preferably balanced for maximum speed and maximum load.

In accordance with a third aspect of the present invention, and yet another application of the "equal but opposite" principle, the (i) connection of the connecting linkage and its piston to the crankshaft at one side of the shaker is one hundred and eighty degrees (180°) angularly opposite to (ii) the connection of other connecting linkage and its piston to the crankshaft at the other side of the shaker. This makes that when one piston, and its affixed sample container and sample, are going "up", then the other piston and affixed sample container and sample are going "down", and vice versa. The action is analogous to the movement of pistons in an internal combustion engine, where the shaker of the present invention is analogous to a two-cylinder engine.

The "up" and "down" inertial forces on the shaker apparatus induced by the oscillatory movement of (i) its parts and (ii) its load thus tend to cancel each other out. Additionally, because the resulting oscillatory torquing forces about the center of gravity of the shaker occur at a rates faster and forces lower than can bring the inertial mass of the shaker into synchronous vibration, the shaker will normally sit relatively quietly in place, perhaps shuddering slightly.

For such vibration as the shaker does incur, it is preferably mounted on a suspension which is normally comprised of springs and/or dampers/shock absorbers. For such (i) airborne and (ii) structureborne, or vibrational, noise as the shaker emits, it is preferably housed with a cabinet that particularly directed to dampening noise of both (i) airborne and (ii) structureborne types.

In total, the several separate, but complimentary, approaches of the present invention permit a powerful shaker to powerfully oscillate a large load at high frequency in but a small volume, with but tolerable vibration and noise. Like most mechanical devices the operation of which is readily understandable, the shaker of the present invention perhaps appears at first glance to be mundane. However, careful assessment of the shaker structure reveals it to incorporate many separate design decisions that produce, in aggregate, superior operational performance.

3. Advanced Jigs for Use With the Shaker of the Present Invention

The shaker of the present invention can be used simply to shake two simple platforms, to which platforms a laboratory experimentalist may attach anything desired. However, the shaker of the present invention is intended to be used with a limited number of versatile jigs. Each jig efficiently adapts from one to many of a large number of different laboratory containers to a standard shaker of the present invention.

The jigs are preferably constructed of lightweight and strong plastic. An inner portion of the jig is tailored to a particular sample container, and holds a number of these sample containers in a grid array. Typically the grid array holder may be loaded with any number of sample containers: one single sample container up to a large number of identical sample containers. The grid array holders are typically molded, and inexpensive. A large number of different grid array holders as are suitable to different types of sample containers all have the same external dimensions and form.

For example, at least two grid array holders are not even unique to the shaker of the present invention, and are derived from standard laboratory well plates. Namely, the laboratory standard well plate that holds ninety-six (96) two-milliliter (2 ml.) test cells, and also the standard well plate that holds four (4) fifteen-milliliter (15 ml.) test tubes, can both be used as grid array holders with the shaker of the present invention. Yet another grid array holder holds a single fifty milliliter (50 ml.) test tube.

It will be recognized that the two "sides" and two pistons of the shaker permit that two jigs, each with a grid array holder, will be simultaneously used. Accordingly, the nominal capacity of the shaker is 2×96=192 two-milliliter (2 ml.) test cells, or 2×4=8 fifteen-milliliter (15 ml.) test tubes.

These grid array holders are loaded with sample containers and are then enclosed within an outer container.

The outer container preferably consists of a thin-wall box that is held, and adapted to the shaker, by (i) an internal external space frame (which may be, and often is, integral with the box) and (ii) a clamping mechanism, commonly an over-center latch. Although all components are most typically made of plastic, the grid array holder is typically the most inexpensive, the enclosing box somewhat more expensive while the external space frame and clamp is the most expensive component.

In use of the jig system of the present invention, an assortment of grid array holders will be procured for such laboratory sample containers of different sizes and configurations as are required to be shaken. A more limited number of enclosing boxes is also procured. Finally, a still more limited number of space frames are procured. Thus one space frame suffices to hold a number of different boxes where each different box typically holds a number of different grid array holders.

In this manner adaptation of additional sample containers to an existing shaking system requires that only limited additional jig components need be bought, and these additional components will most likely be of the more inexpensive varieties.

4. Programmability of the Shaker in Accordance With the Present Invention

The shaker of the present invention is programmable, and incorporates a microprocessor controller. A human operator specifies the speed and duration parameter of a shaking protocol, which protocol may extend over indefinitely many shaking and rest periods each of operator-defined duration. Once programmed, the shaker "remembers" the protocol, which may thereafter be invoked simply by pressing a button, most preferably a (i) programmable function (ii) push button switch. Alert and status indications in the form or visible (and/or audible) warnings and alerts are also made.

These and other aspects and attributes of the present invention will become increasingly clear upon reference to the following drawings and accompanying specification.

BRIEF DESCRIPTION OF THE DRAWINGS

Referring particularly to the drawings for the purpose of illustration only and not to limit the scope of the invention in any way, these illustrations follow:

FIG. 4 is a diagrammatic perspective view of two exemplary first-type jigs, each holding specimen containers, fitted to the tops of the pistons of the preferred embodiment of the shaker in accordance with the present invention previously seen in FIGS. 1–3.

FIG. 5, consisting of FIGS. 5*a* through 5*d*, is an exploded diagrammatic perspective view of various jigs, holding specimen containers, that are usable with the preferred embodiment of the shaker in accordance with the present invention previously seen in FIGS. 1–3.

DESCRIPTION OF THE PREFERRED EMBODIMENT

Although specific embodiments of the invention will now be described with reference to the drawings, it should be understood that such embodiments are by way of example only and are merely illustrative of but a small number of the many possible specific embodiments to which the principles of the invention may be applied. Various changes and modifications obvious to one skilled in the art to which the invention pertains are deemed to be within the spirit, scope and contemplation of the invention as further defined in the appended claims.

Figure 1:
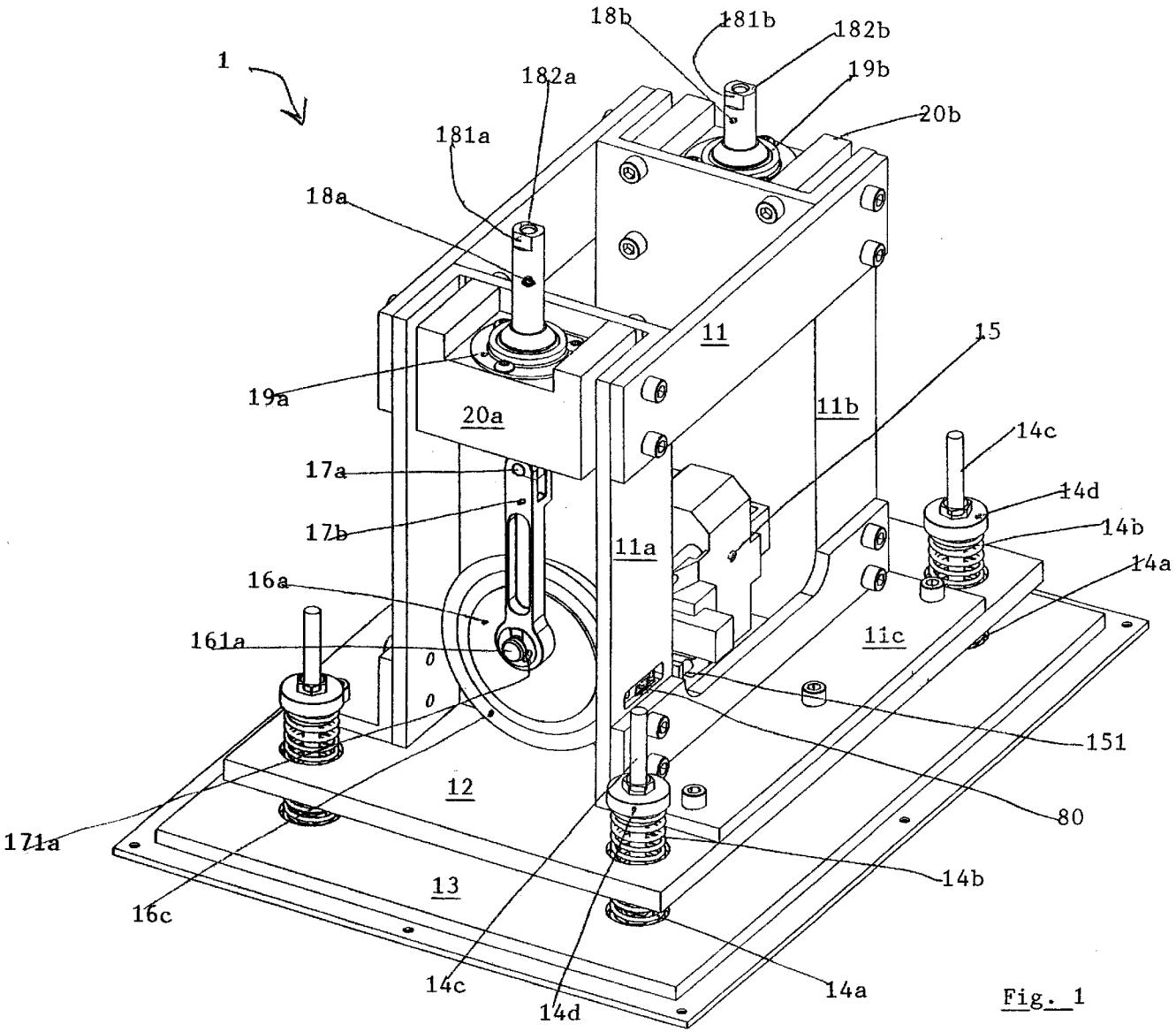
FIG. 1 is a diagrammatic perspective view showing a preferred embodiment of a shaker in accordance with the present invention exposed, and outside its case that is shown in FIG. 6.
Figure 2:
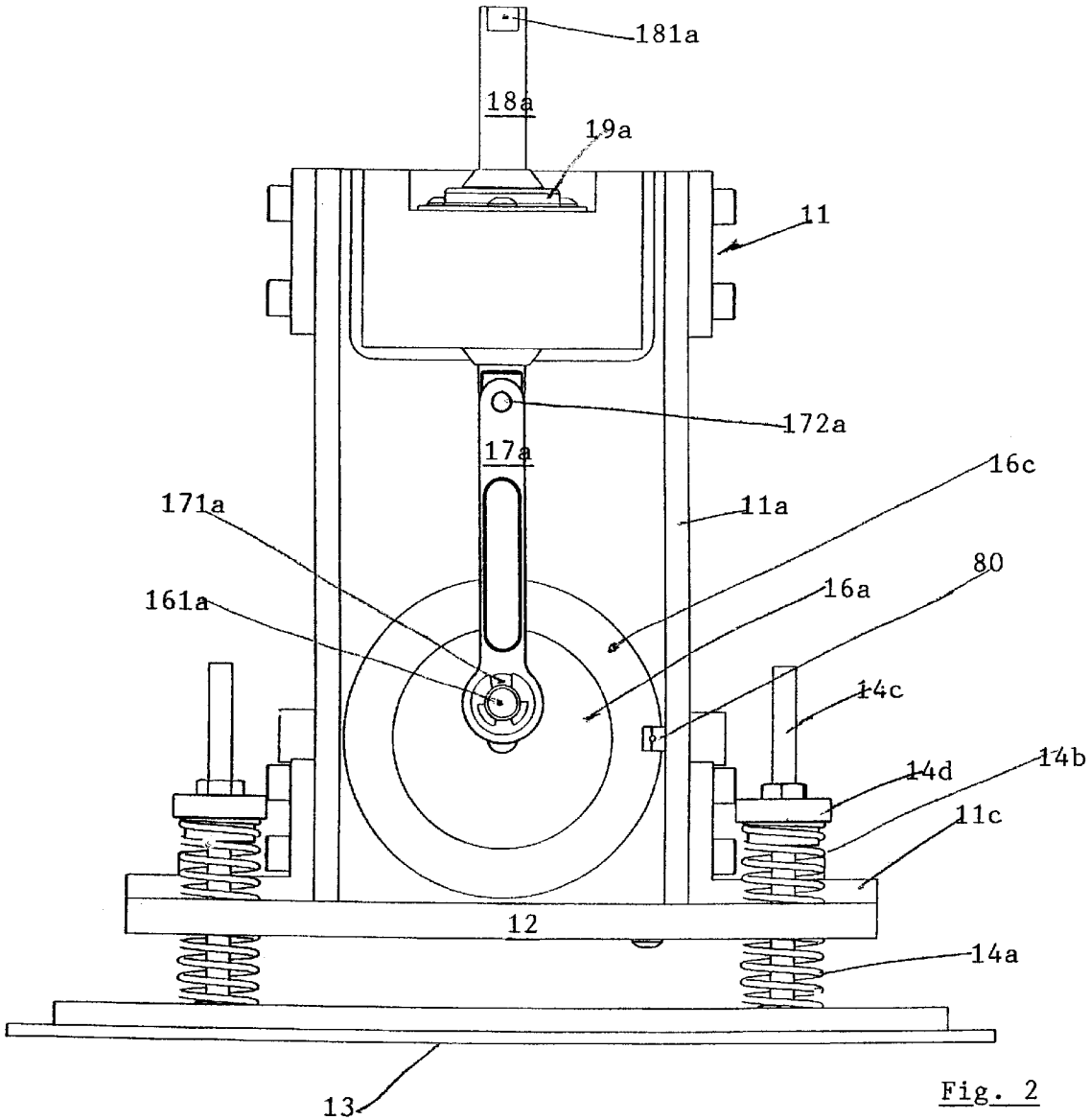
FIG. 2 is a side plan view of the preferred embodiment of the shaker in accordance with the present invention previously seen in FIG. 1.
Figure 3:
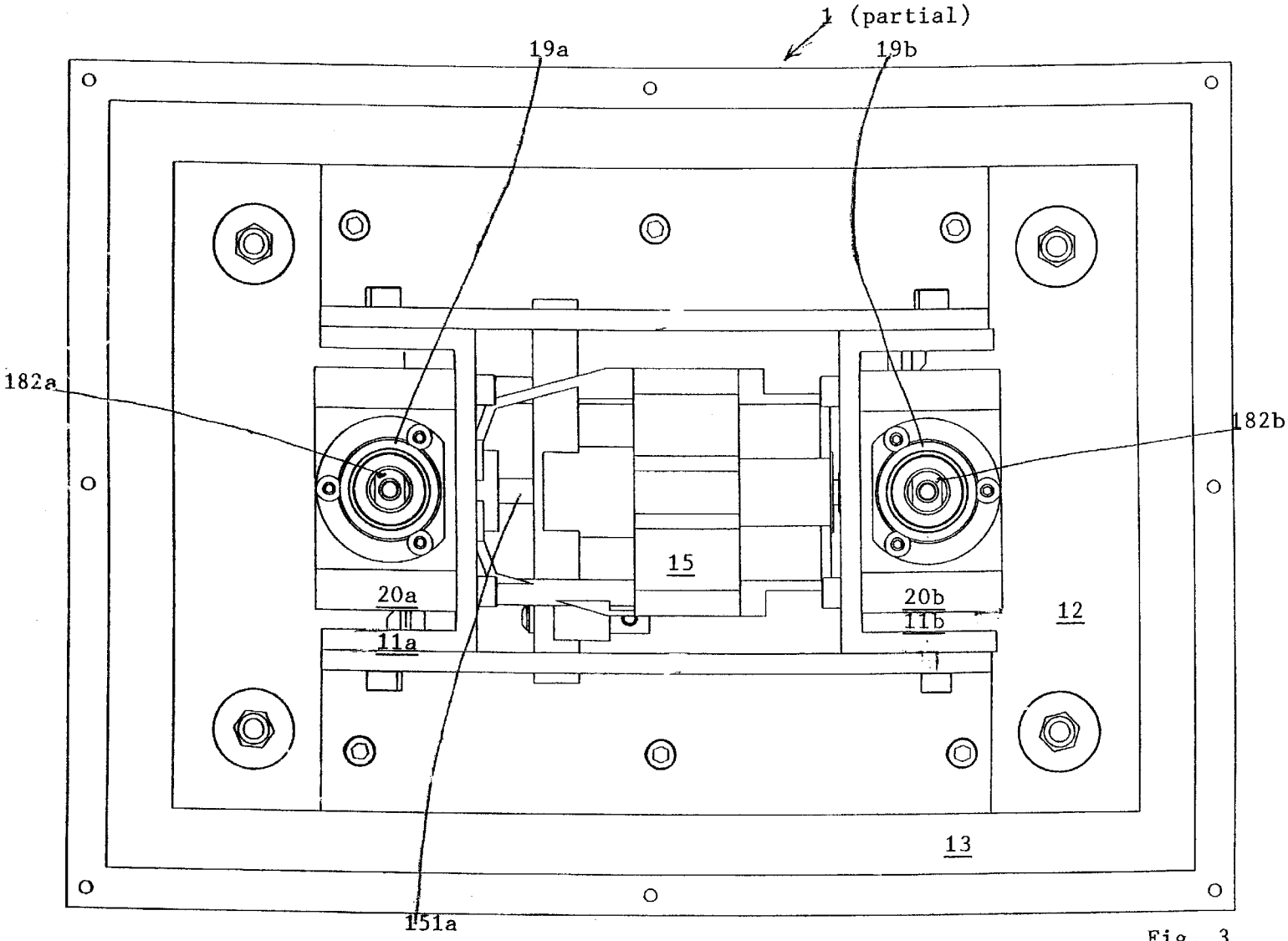
FIG. 3 is a top plan view of the preferred embodiment of the shaker in accordance with the present invention previously seen in FIGS. 1 and 2.

A preferred embodiment of a shaker 1 in accordance with the present invention is respectively shown in diagrammatic perspective, side plan, and top plan views in FIGS. 1–3. During operational use the shaker 1 is normally covered with a case (shown in FIG. 6) exposing only (i) the control panel (shown and discussed hereinafter in conjunction with FIG. 6) of the motor 15, and (ii) the upwards extending tops, or knobs, or attachment features 181*a*, 181*b* and 181*b*, 182*b* of the reciprocating pistons, or oscillating shafts 18*a*, 18*b* (as hereinafter discussed).

The shaker 1, which is built of metal and most commonly aluminum, is based on a substantial and strong rectilinear frame, or stanchion, 11 affixed to a first, or upper, tie plate 12. This first, upper, tie plate 12 is held in suspension roughly level and equidistant from a second, lower, base plate 13 by springs 14*a* and 14*b* held on threaded shafts 14*c* by spring retainers 14*d*. Normally four lower springs 14*a*, and four upper springs 14*b*, are used.

Two upstanding, left and right, frame portions, or stanchions, 11*a*, 11*b* are defined. The overall size of the preferred embodiment of a shaker 1 in accordance with the present invention is nominally 10.75" w by 17.6" d by 12" h—although a practitioner of the mechanical arts will understand that the shaker 1 may be otherwise scaled.

A motor 15 is held fixed within the frame 11, specifically on frame stanchions 11*a* and 11*b*, and upon the upper base plate 12 by a motor bracket 151. The motor 15 is preferably alternating current (a.c.) available as a modified 4910 series motor from GS Electronics, Carlisle, Pa. The motor is controlled by a microprocessor controller (behind a control panel shown in FIG. 6). An accessible control panel (exposed to the exterior of the case, shown in FIG. 6 and discussed hereinafter) may be set to operate the motor under any load up to full load from 300–6000 revolutions per minute (rpm) for nominal durations from 1 to 300 seconds.

The motor 15 has oppositely-extending extensions 151*a*, 151*b* of its central shaft 151, of which extension 151*a* is most clearly visible in FIG. 3. Although the motor 15 has internal bearings, the shaft extensions 151*a*, 151*b* preferably pass through bearings (not shown) in the stanchions 11*a*, 11*b* of the frame 11. The preferred bearing is Fafnir type SK5PP. The most preferred bearing has an OD of 1.1250 inches, a bore of 0.5000 inches, and a 0.312 inch width.

Each shaft extension 151*a*, 151*b* (shaft extension 151*a* shown in FIG. 3, shaft extension 151*b* not shown) fits to an associated flywheel 16*a*, 16*b* (flywheel 16*a* shown in FIGS. 1 and 2, flywheel 16*b* not shown). The flywheels 16*a*, 16*b* are preferably round, and are concentrically mounted to the associated shaft extensions 151*a*, 151*b*—although each flywheel 16*a*, 16*b* has eccentric peripheral weighing.

Each flywheel 16*a*, 16*b* affixes a corresponding eccentric post, or crank pin, 161*a*, 161*b* (crank pin 161*a* shown in FIGS. 1 and 2, crank pin 161*b* not shown). The displacement of the eccentric posts, or crank pins, 161*a*, 161*b* from the center line of the central shaft 151 determines the magnitude of the oscillation imparted to the sample containers and samples, and this displacement is preferably from ¼" to ½" as imparts an oscillation cycle length from ½" to 1", and is more preferably ⅜" as imparts an oscillation cycle length of ¾". The crank pins 161*a*, 161*b* are normally sturdy and of substantial, ⅜" diameter, as best suits the substantial forces that they transmit.

In accordance with the present invention, the flywheels 16*a*, 16*b*, although concentrically mounted to shaft extensions 151*a*, 151*b*, are not mounted so that their eccentric posts, or crank pins, 161*a*, 161*b* are at the same angular displacement. In fact, the crank pins 161*a*, 161*b* of the two flywheels 16*a*, 16*b* are diametrically angularly opposite, with one being bottom dead center, or 180°, while the other is at top dead center, or 0°, and vice versa. This angular relationship is shown in FIG. 1 (and again in FIG. 6) where the top 182*a* of piston 18*a* is maximally elevated simultaneously that the top 182*b* of piston 18*b* is maximally depressed—as is a direct consequence of this "out of phase" positioning of the crank pins 161*a*, 161*b* on the two flywheels 16*a*, 16*b*.

Figure 7:
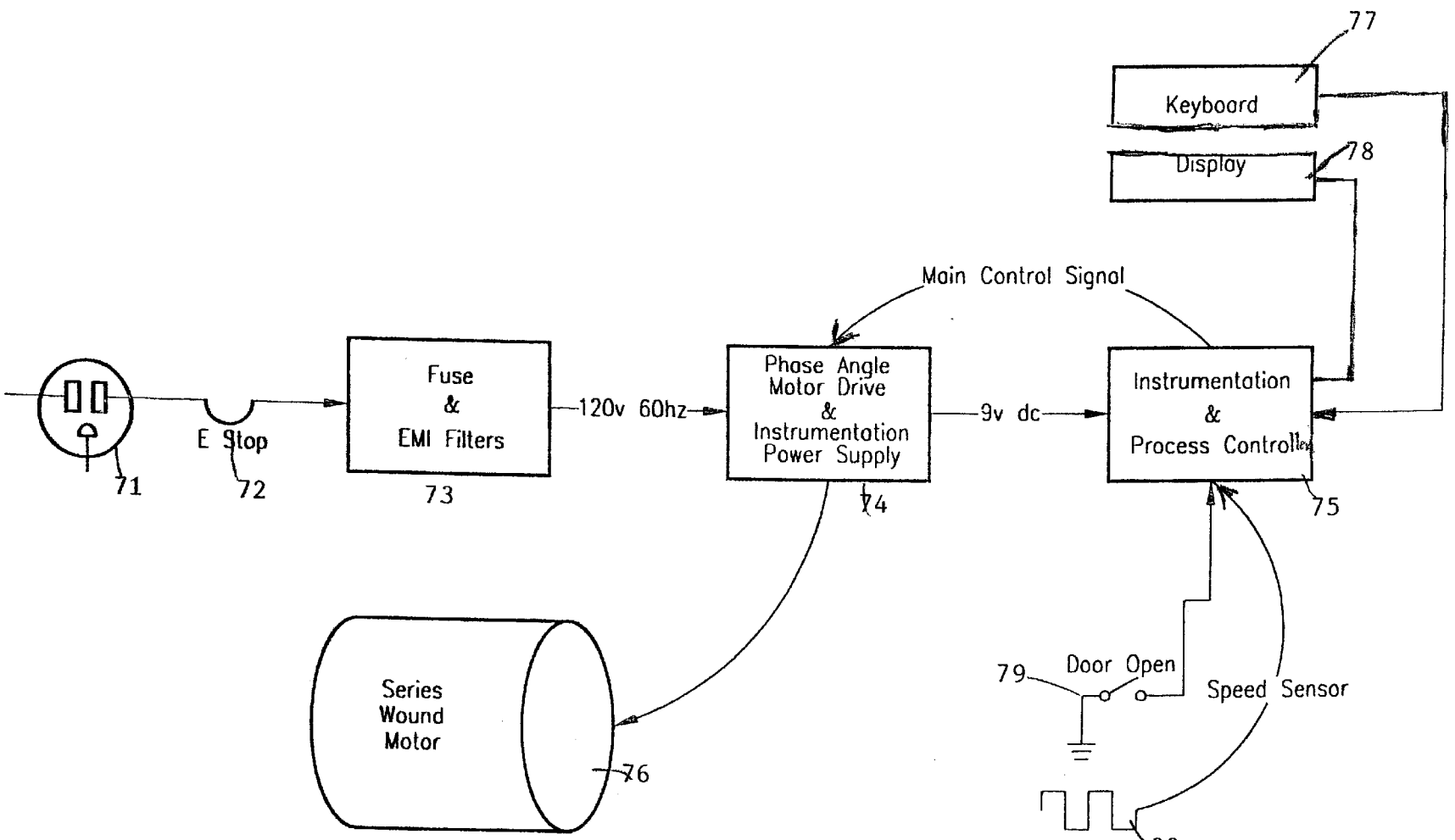
FIG. 7 is a block diagram of the preferred embodiment of a shaker in accordance with the present invention, previously seen in FIGS. 1–6.

One of the flywheels 16*a*, 16*b*—illustrated to be flywheel 16*a*—mounts at its periphery an encoder disk 16*c*. This encoder disk 16 presents a pattern of alternating light and dark areas, normally 180 such sectors, which can be detected by optical sensor, or interrupter switch 80 that is mounted opposite the rotating encoder disk 16c on the frame stanchion 11*a* (or 11*b*) of the frame 11. The electrical signal output of the interrupter switch 80, which will be further seen in FIG. 7, is a pulse train in respect of the rotation of the encoder disk 16*c*, the flywheels 16*a* and 16*b*, and the motor 15; and also of the reciprocating motion of the shaker 1.

A linkage 17*a*, 17*b* connects the respective crank pins 161*a*, 161*b* of flywheels 16*a*, 16*b* to respective pistons 18*a*, 18*b*. (Linkage 17*a* is shown in FIGS. 1 and 2; linkage 17*b* is not shown). Each linkage 17*a*, 17*b* connects to its respective crank pin 161*a*, 161*b* though a needle bearing 171*a*, 171*b*. (Needle bearing 171*a* is shown in FIGS. 1 and 2; needle bearing 171*b* is not shown). The preferred linkage or connecting rod, to crank pin bearing is type AV24K40 of the ABEC-5T series available from Torrington. The preferred bearing has an OD of 0.5620 inches, a bore of 0.3750 inches, and a 0.3120 inch width.

A wrist pin 172*a*, 172*b* at the other end of the linkages 17*a*, 17*b* rotationally connects to the base of the pistons 18*a*, 18*b* through bearings 181*a*, 181*b*. (Linkage and wrist pin 172*a* are shown in FIGS. 1 and 2; linkage 17*b* and wrist pin 172*b* are not shown. Neither bearing 181*a*, 181*b* is shown, but each fits about a respective wrist pin 172*a*, 172*b*.) The preferred bearings 181*a*, 181*b* are Torrington type B34 having an O.D. of 0.343 and I.D. of 0.1875 (3/16) inches Each piston 18*a*, 18*b* is guided for strictly straight-line linear reciprocating motion by a respective linear motion bearing 19*a*, 19*b*. The preferred motion bearing is type MLF 500-875-1 available from Rotalin of England. This bearing is, and in accordance with the stresses of the shaker of the present invention must be, high performance, and is most preferably a very high performance bearing. Both linear motion bearings 19*a*, 19*b* are firmly mounted in bearing carriers 20*a*, 20*b*, and to the frame 11. The tops, or butt ends, of the shafts, or pistons, 18*a*, 18*b* have and present features 181*a*, 182*a* and 181*b*, 182*b* to which the sample containers may strongly attach. The feature 181*a*, 181*b* is in the form of two oppositely opposed, relieved, areas of the tops, or butt ends, of the shafts, or pistons, 18*a*, 18*b* which relieved areas are complimentary with a bore in the bottom of each jig fixture 4, next discussed. The relieved areas at the tops, or butt ends, of the shafts, or pistons, 18*a*, 18*b* align the fixtures 4, and keep them from angularly turning. The feature 182*a*, 182*b* is in the form of a threaded bore into the tops, or butt ends, of the shafts, or pistons, 18*a*, 18*b*. These threaded bores 182*a*, 182*b* receive a bolt, or screw (not shown) extending from the bottom of each jig fixture 4, which bolt, or screw, holds each jig fixture 4, next discussed, removably affixed to a top, or butt end, of a respective shaft, or piston, 18*a*, 18*b*.

Two exemplary specimen-container-holding jig fixtures 4 suitable for use with the shaker of the present invention (as has just been seen and explained) are shown in perspective view in FIG. 4. Exploded views of a number of externally identical jig fixtures 4 as hold various contents are shown in FIG. 5. Each jig fixture 4, of which a pair are shown in FIG. 4 and one in each of FIGS. 5*a* through 5*d*, removably mounts to one top 182*a*, 182*b* of one piston 18*a*, 18*b* at one time. The jig fixtures preferably so mount by screwing to threaded shaft at the tops 182*a*, 182*b* of the piston 18*a*, 18*b*. Each jig fixture 4 has a turning radius whereby it may be removed and replaced independently of the other. Normally the jig fixtures 4 remain mounted indefinitely and removed only for cleaning, with their contents only being replaced as will be illustrated in FIG. 5.

It will be recognized that the jig fixtures 4, and the particular jig fixtures 4 that are illustrated, are not integral to the shaker of the present invention, but are illustrated only so as to shown the environment of the invention, and the holding within specimen containers of those samples on which the shaker of the present invention serves to operate.

Each of the exemplary pair of jig fixtures 4 shown in FIG. 4 is in the substantial shape of rectilinear boxes, and closes shut such as by lid hinges 41 to contain diverse specimens, including specimens as are contained in small test tube and/or micro specimen containers (not shown in FIG. 4, shown in FIG. 5).

Various embodiments of internal holders, or fixtures, 51–54 us usable with, and inside, the single jig fixture 4, and also with the preferred embodiment of the shaker 1 in accordance with the present invention, are respectively shown in FIGS. 5*a* through 5*d*. The internal holder, or fixture, 51 shown in FIG. 5*a* is in the substantial shape of a tray which fits to a complementary recess in the jig fixture 4. The tray fixture 51 holds, by way of example, small test tubes or containers 61, as illustrated.

The internal holder, or fixture, 52 shown in FIG. 5*b* is in the substantial shape of a rack with vertical apertures. The rack fixture 52 holds, by way of example, small test tubes or containers (not shown).

The internal holders, or fixtures, 53 and 54 respectively shown in FIGS. 5*c* and 5*d* are in the substantial shape of racks with horizontal apertures. These rack fixtures 53. 54 holds, by way of example, large test tubes or containers, as shown.

In all applications the jig fixture 4 in the substantial shape of a rectilinear box is preferably universal, and made of plastic, With an inner holder, or frame, 51–54 it suffices to hold diverse containers and test tubes.

The internal holders 51–54 need not be unique to the shaker 1 of the present invention. A standard laboratory well plate that holds ninety-six (96) two-milliliter (2 ml.) test cells, of a standard well plate that holds four fifteen-milliliter (15 ml). test tubes, can both be used as grid array holders 55 with the shaker 1 of the present invention. Yet another holder (not shown) holds one single fifty milliliter (50 ml.) test tube.

It will be recognized that the two pistons, or shafts, 18*a*, 18*b* of the shaker 1 permit that two jig fixtures 4, each with an internal holder 51–51, to be used simultaneously. Accordingly, the nominal capacity of the shaker is 2×96=194 two milliliter (2 ml.) test cells, or 2×4=8 fifteen milliliter (15 ml.) test tubes, or one fifty milliliter (50 ml.) test tube.

Most generally, the fixtures 4, 51–54 should be considered to be comprised of 1) a grid array holder, tailored to hold one or more sample containers of a particular configuration, such as the grid array holder 51–54 shown in FIG. 5. It will be recognized by a practitioner of the mechanical arts that the grid array holder could look quite different depending upon the particular specimen, or sample, containers held.

The jig fixtures 4, 5–54 also are also suitable to contain boxes directly holding samples, in contour much like the interior fixture 52 shown in FIG. 5*b*.

Finally, the jig fixtures 4, 51–54 preferably comprise 3) an external space frame holding and clamping shut the 2) box with the at least one 1) grid array holder holding one or more sample containers held within the box. This external space frame is most clearly visible as the hinge 41 in FIG. 4. In FIG. 4 the external frame is partially combined with the box.

The space frame of the jig fixture has and presents an engagement feature complimentary to the engagement feature of the top region of each piston. The jig fixture is thus mountable by its engagement feature to a piston for oscillatory shaking during operation of the shaker.

Figure 6:
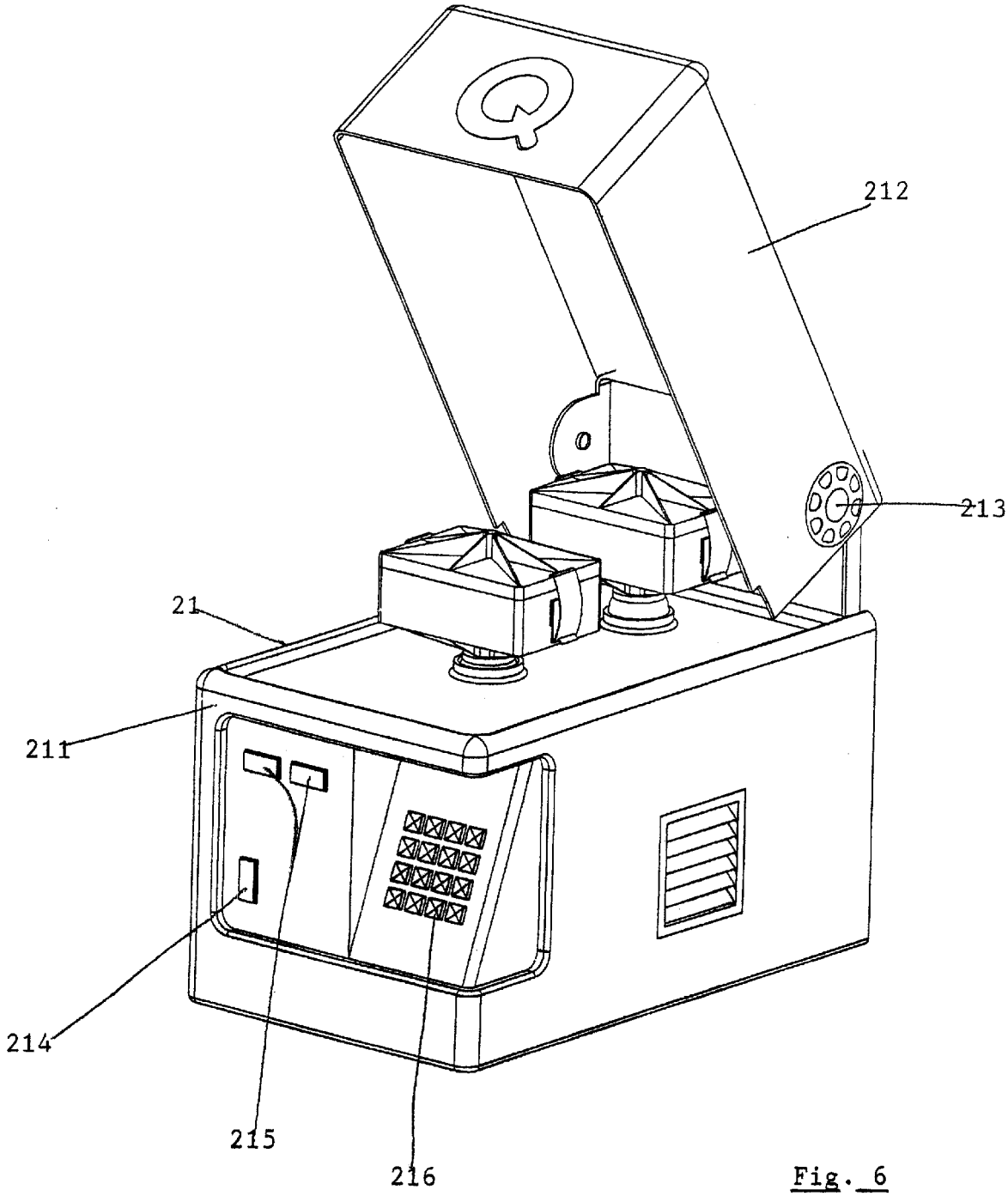
FIG. 6 is a diagrammatic perspective view showing the preferred embodiment of a shaker in accordance with the present invention, previously seen in FIGS. 1–5, within its case.

The preferred embodiment of a shaker 1 in accordance with the present invention located within its case 21 is shown in FIG. 6. The case 1 has an opaque bottom portion 211 that is permanently attached by screws to the base plate 13 (shown in FIG. 1) in the manner of the case of a personal computer. The interior of the bottom portion 211 of the case 21 is lined with airborne and structureborne noise-suppressing Tuftane$^{SM}$ polyurethane foam (not shown)

available as item number TCom24block from Architectural Surfaces, Inc. of Chaska, Minn.

A transparent top portion 212 is removable or, preferably, hinged at hinge joint 213, to enclose the two jigs 4 as are mounted to the tip ends of the pistons, or shafts, 18*a*, 18*b* (not shown in FIG. 6, shown in FIGS. 1–3).

An on/off switch 214, indicators 215, and a push button control panel 216 permit control of the shaker 1. The indicators 215 and control panel 216 are in particular connected to a microprocessor (not shown) within the case 21 which microprocessor controls, through appropriate power circuitry, actuation of the motor 15 (now shown in FIG. 6, shown in FIG. 1).

A block diagram of the preferred embodiment of the shaker 1 in accordance with the present invention, previously seen in FIGS. 1–6, is shown in FIG. 7. External a.c. power 71 is provided through a fuse E Stop 72 to Phase Angle Motor Drive & Instrumentation Power Supply 74. This Phase Angle Motor Drive & Instrumentation Power Supply 74 supplies (i) 9 v dc power to the Instrumentation and Processor Controller 75, and, under control of a Main Control Signal received from the Instrumentation and Processor Controller 75, (ii) power drive to the Series Wound Motor 76. (The series wound motor 76 is the drive motor part of the motor 15 shown in FIG. 1, which motor 15 also includes frame and mounting elements.)

The Instrumentation and Processor Controller 75, which is the core of the shaker 1 control, receives inputs from (i) an interrupter switch 80 (as was previously seen in FIGS. 1 and 32, and described in association with these figures) essentially acting as a tachometer Speed Sensor 80. As will be recalled, the interrupter switch, or tachometer Speed Sensor 80 generates a pulse train, illustrated in FIG. 7, that is respective of the rotation of the shaft (not shown) of the Series Wound Motor 76. The Instrumentation and Processor Controller 75 also receives (ii) a binary Door Open signal responsive to the position of the cover, or transparent top portion 212 previously seen in FIG. 6, and (iii) key press signals from a keyboard 77 (also shown in FIG. 6).

The Instrumentation and Processor Controller 75 produces outputs to (i) Display 78 (also shown in FIG. 6), and, as the Main Control Signal, a motor drive control signal to the (ii) Phase Angle Motor Drive & Instrumentation Power Supply 74.

A schematic diagram of the Instrumentation and Processor Controller section 75 of the preferred embodiment of a shaker 1 in accordance with the present invention is shown in FIGS. 8*a*–8*e*.

The identification of parts is as follows:

J1 plugjacks

J2 termination plugjack

J3 termination plugjack (RS485/RS422)

J4 plugjack

J5 plugjack

R1 resistor, 1K ohms

R2 resistor, 1K ohms

R3 resistor, 10K ohms

R4 resistor, 1K ohms

R5 resistor, 4.7K ohms

R6 resistor, 1K ohms

R7 resistor, 100 ohms

R8 resistor, 10K ohms

R17 resistor, 10K ohms

R18 resistor, 10K ohms

R19 resistor, 10K ohms

C5 capacitor, 0.1 microfarads 50 v

C6 capacitor, 0.1 microfarads 50 v

C7 capacitor, 0.1 microfarads 50 v

C8 capacitor, 0.1 microfarads 50 v

C9 capacitor, 0.1 microfarads 50 v

C10 capacitor, 27 picofarads 50 v

C11 capacitor, 27 picofarads 50 v

C12 capacitor, 1000 picofarads 50 v

U1 integrated circuit, industry standard part no. 74HC245AWM

U2 integrated circuit, industry standard part no. 74HC573AWM

U3 integrated circuit, 8 bit microprocessor, microprocessor part no. ATML/AT89C55-33JC (requires programming)

U4 integrated circuit, NEC part no. D43256BGU-85L

U5 integrated circuit, AD part no. AD8400AR10

U6 integrated circuit, LT part no. LT1387CG

U7 integrated circuit, MAX part no. MAX813LCSA

U8 integrated circuit, industry standard part no. HDSP211X

U9 integrated circuit, industry standard part no. 24C01C/SN

U10 integrated circuit, industry standard part no. HDSP211X

U11 integrated circuit, industry standard part no. 74HC138M

U12 integrated circuit, industry standard part no. 74HC573AWM

U13 integrated circuit, industry standard part no. 74HC541AWM

U14 integrated circuit, industry standard part no. 74HC00M

U15 integrated circuit, industry standard part no. 74HC04M

U16 integrated circuit, industry standard part no. 74HC00M

X1 crystal, 11.059 MHz.

D1 photodiode type

Q1 transistor type MMBT3904LT1

BUZ1 TMB05 buzzer Panasonic audio transducer EAF-8RM08EF

Displays Siemans part no. PDSP1883

It will be understood by a practitioner of the electrical arts that various additional resistors may attach to various signal lines to perform a "pull-up" function, and that various additional capacitors may be used for signal smoothing, all as is routine in consideration of circuit board layout, signal noise environment, etc.

Considering the schematic diagram of the Instrumentation and Processor Controller section 75 shown in FIGS. 8*a*–8*e*, although some major signals are traced between drawings sheets, many signals will seen to appear unconnected. A practitioner in the art will recognize that these apparently unconnected signals are all named, and that the names of the signals may readily be located at various places in the schematic. The signals are of course connected, and common, at all points of occurrence, it simply being unwieldy to. trace every signal through all points of its distribution.

Continuing in the schematic diagram of the Instrumentation and Processor Controller section 75 shown in FIGS. 8*a*–8*e*, besides power and ground inputs, signal inputs are received at jack J3 pin 3 (see FIG. 8*b*) from the tachometer Speed Sensor 80 (shown in FIG. 7); at jack J7 (see FIG. 8*d*) from the Door Open switch 79 (shown in FIG. 7), and at jack J6 (see FIG. 8*e*) from the Keyboard 77 (shown in FIG. 7). A further signal bus selectably of the RS-232C, RS-422, or RS-485 type is presented at jack J4 (see FIG. 8*a*).

The Instrumentation and Processor Controller section 75 produces outputs (i) at jack J1 pin 3 (see FIGS. 8*a*) as the Main Control Signal to the Phase Angle Motor Drive & Instrumentation Power Supply 74 (shown in FIG. 7), and (ii) at jack J6 (see FIG. 8*e*) from the Keyboard 77 (shown in FIG. 7). The Main Control Signal at jack J1 pin 3 (see FIG. 8*a*) is a d.c. signal of 0 to 5 v.d.c. amplitude, which signal serves to control the speed of the drive by the Series Wound Motor 76 (shown in FIG. 7).

Figure 8A:
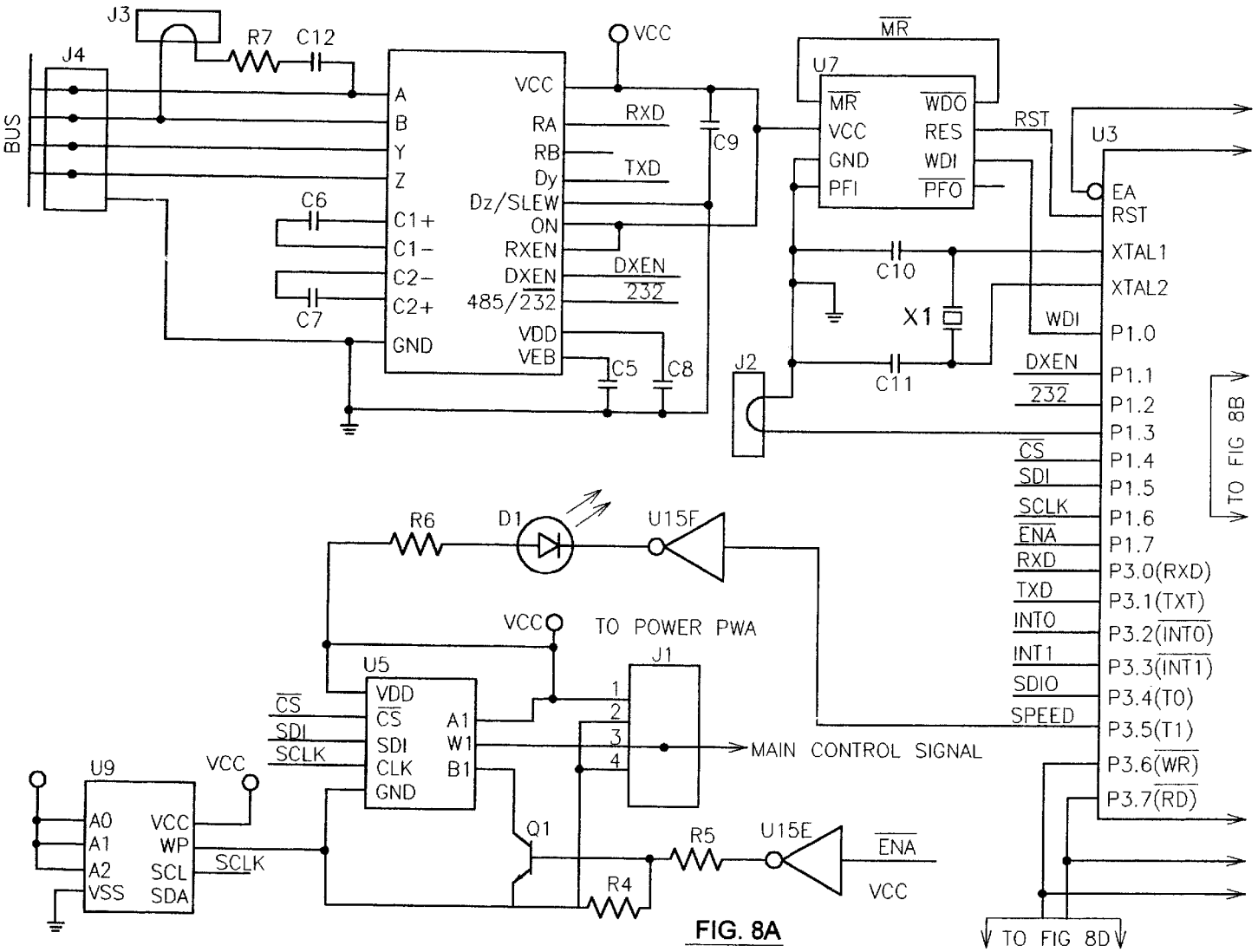
FIG. 8, consisting of FIGS. 8*a* through 8*e*, is a schematic diagram of the Instrumentation and Processor Controller section of the preferred embodiment of a shaker in accordance with the present invention.

In operation, and starting at FIG. 8*a*, any communication signals from, by way of example, an external computer received at the jack J1 upon an interface that is programmably controlled to be any of the RS-232C, RS-422, or RS-485 types is converted to TTL logic levels in level converter/translator U6 and communicated through the watchdog timer U7 to the microprocessor U3. The watchdog timer U7 serves to (i) monitor power, including so as to (ii) guarantee a reset on power up.

Also shown in FIG. 8*a* is the amplification and shaping of the SPEED signal output from the microprocessor U3 to produce the Main Signal Output. This process uses an inverted amplifier U15F, diode isolation realized by photodiode D1, and amplification in power amplifier U5. The final signal output is gated by enablement signal ENA as amplified by level converter U15E and transistor Q1. The timing parameters for the particular motor in use are contained in EEPROM U9, readable and writable by microprocessor U3, which stores these parameters plus any shaking sequences that are programmed into the shaker 1 (by use of the keyboard interface, to be discussed) by its user-operators. For those persons unfamiliar with digitally-based motor control, motor timing parameters essentially relate to how much control signal, translated into motor drive current, must be applied for how long to effect a desired change in the motor and in the shaking rate, for example to increase from 1000 cpm to 2000 cpm. The ability to store user-defined shaking sequences even when the shaker 1 is powered down is one of the features of the present invention.

Figure 8B:
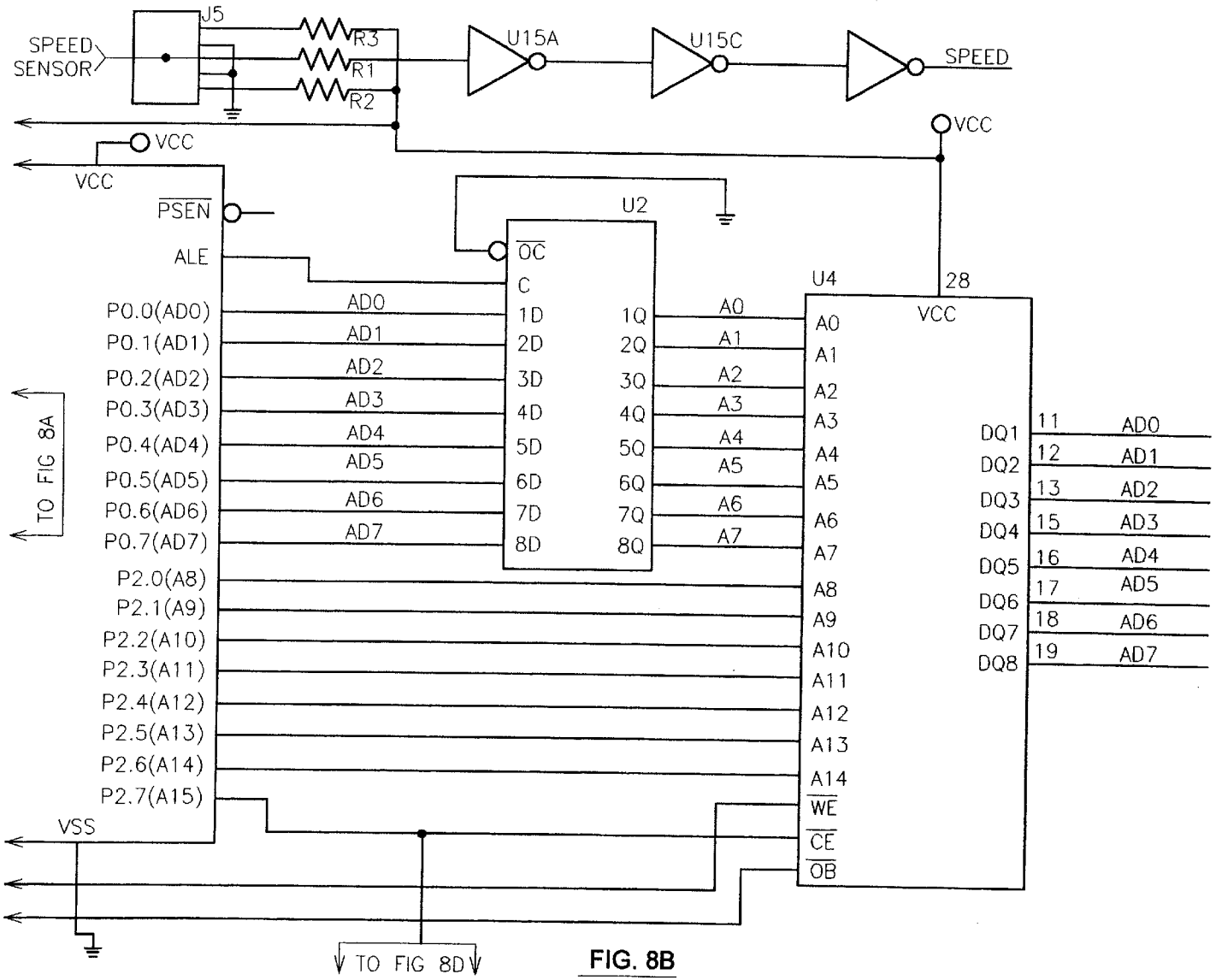

Continuing in FIG. 8*b*, a quite conventional connection of a microprocessor to its memory is shown therein. Namely, microprocessor U3 communicates through address decoder U2 to read information from, and write information to, SDRAM U4.

Of greater interest in FIG. 8*b* is the receipt at plug jack J5 pin 3 of the Speed Sensor signal from the tachometer Speed Sensor 80 (shown in FIG. 7). After amplification in inverters U15A and U15C, the signal is supplied for further use.

Figure 8C:
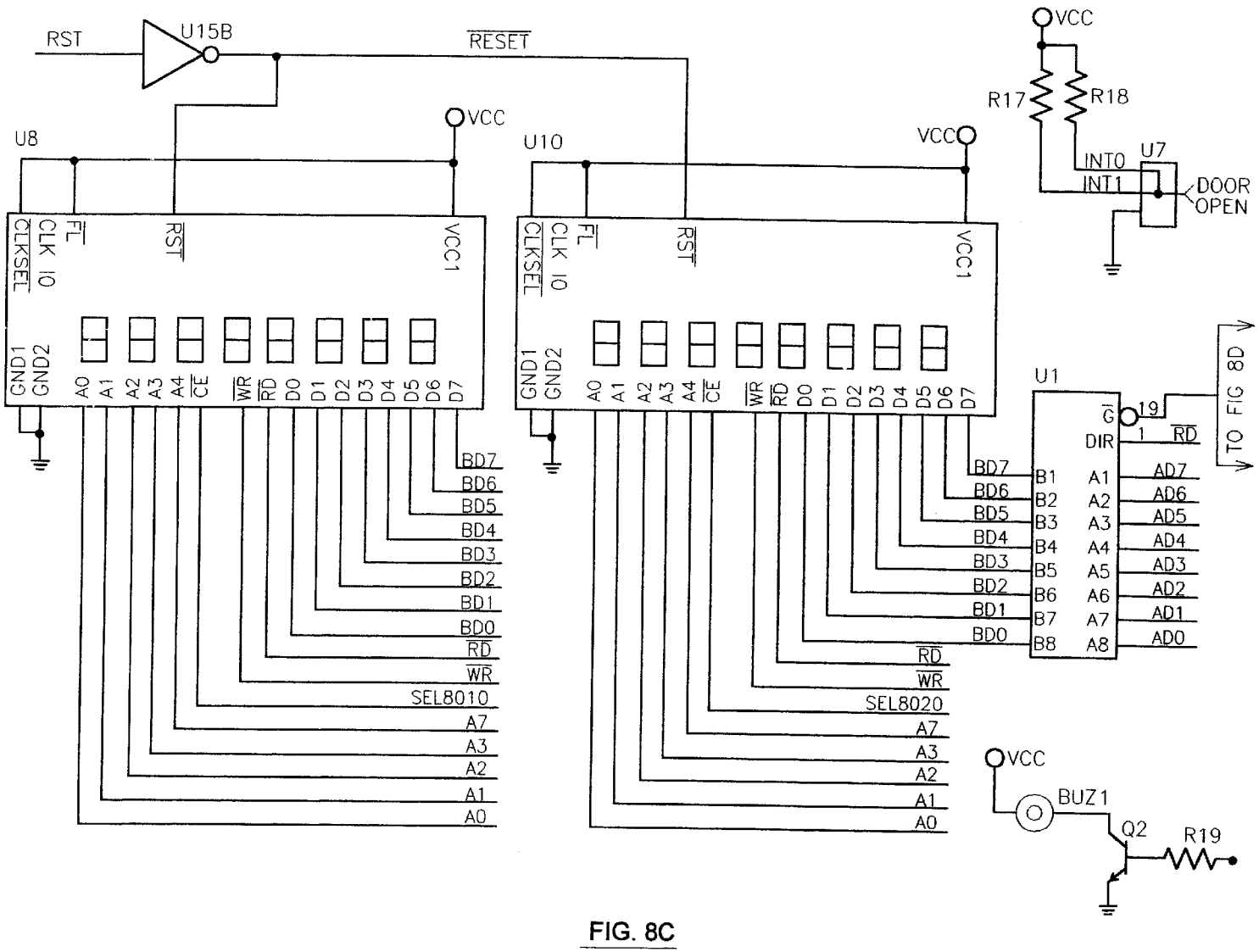

Continuing in FIG. 8*c*, the left/upper display U8 and the right/lower display U10, both part of D78 shown in FIG. 7, are shown therein. These eight-character displays are conventionally addressed by the microprocessor U3 with and address held in address latch U1, and are loaded with data from the microprocessor data bus, all under program control. Most typically the left/upper display U8 presents a prompt for a user-operator input when the shaker 1 is not operating, and the right/lower display U10 presents the user/operator data as and when entered. When the shaker 1 is operating, the left/upper display U8 preferably presents the remaining shaking time while the right/lower display U10 presents the instantaneous shaking rate.

Also in FIG. 8*c* is the jack J7 where is received the Door Open signal from the Door Open sensor 79 shown in FIG. 7. As indicated by the naming of signal INT0 and INT1, this signal is distributed, most particularly to the microprocessor U3, as an interrupt. The program running in the microprocessor U3 will, quite naturally, interpret this interrupt to stop any shaking. Any re-start after the cover is closed demands user-operator intervention at the keyboard.

Finally shown in FIG. 8*c* is the buzzer BUZ1. The buzzer is primarily used as an audible confirmation (under program control) of the press of each key (as enters control or data) at the keyboard, but may also, optionally, be used (still under program control) as an alarm when, for example, an applied Main Control Signal fails to produce (after reasonable interval) motor rotation (as evidenced by the Speed Sensor signal) and shaking. Such an error or failure condition might occur if the motor or drive mechanism had failed, or the shaker was jammed.

Figure 8D:
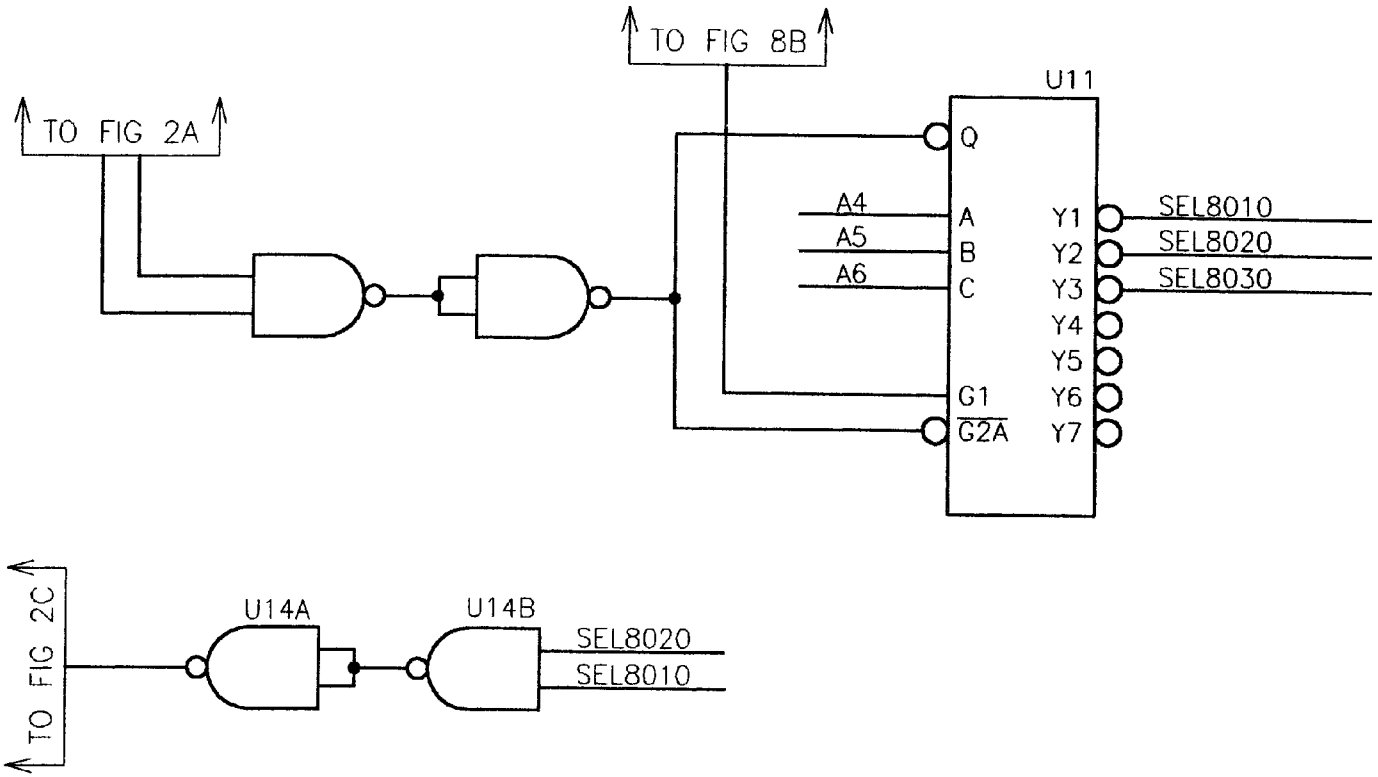
Figure 8E:
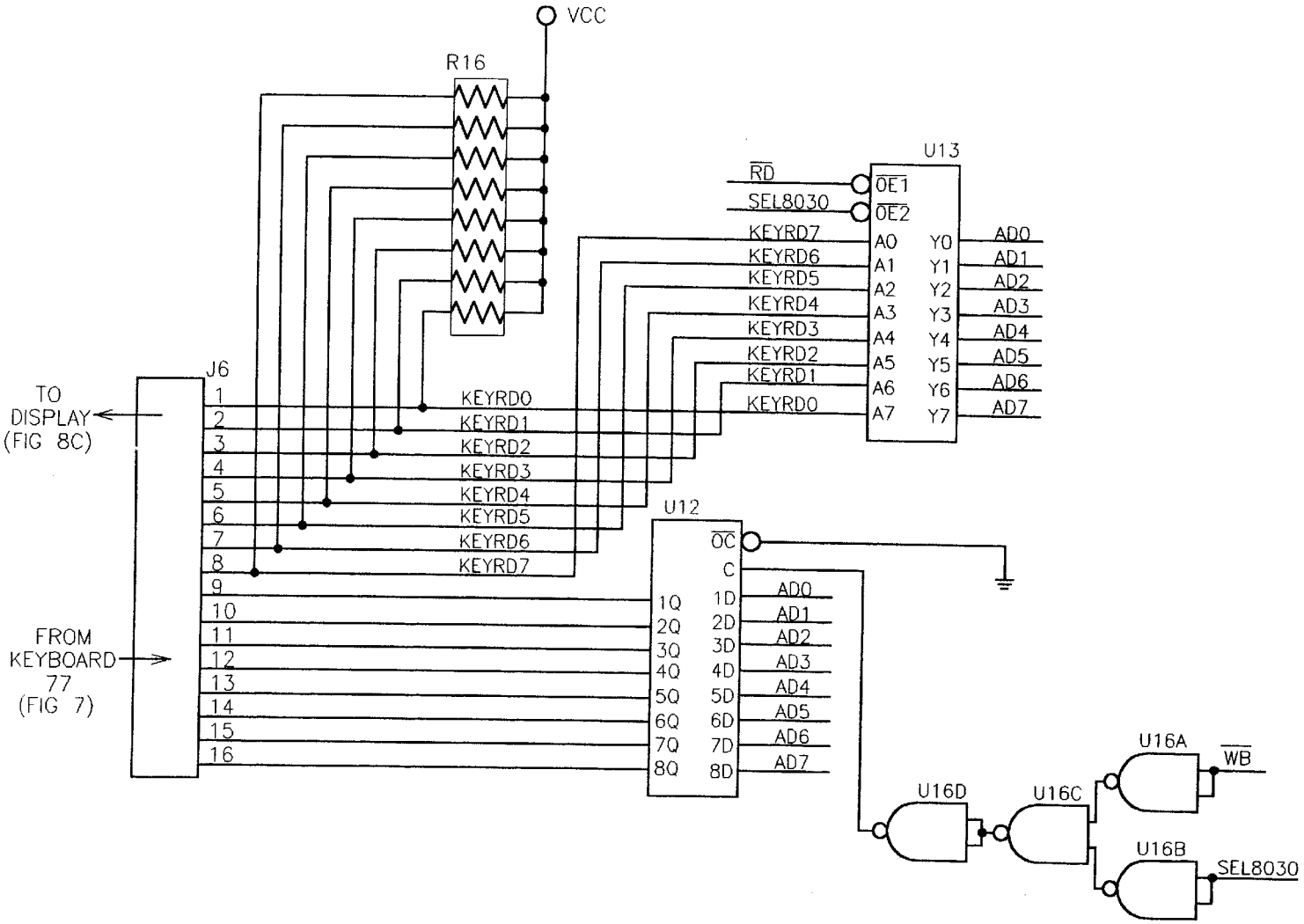

Remaining FIGS. 8*d* and 8*e* show the conventional multiplexed selection logic by which a single microprocessor U3 communicates upon a data bus, in the present case, with three separate addressable components. Namely, the microprocessor U3 can selectively communicate, under program control as translated in the logic of FIGS. 8*d* and 8*e*, with each of two displays U8, U10 seen in FIG. 8*c*, and one Keyboard 77 (seen in FIG. 7). In particular, both the display 78 and the Keyboard 77 (both seen in FIG. 7) are connected to, and through, the plugjack J6 shown in FIG. 8*e*.

Figure 9:
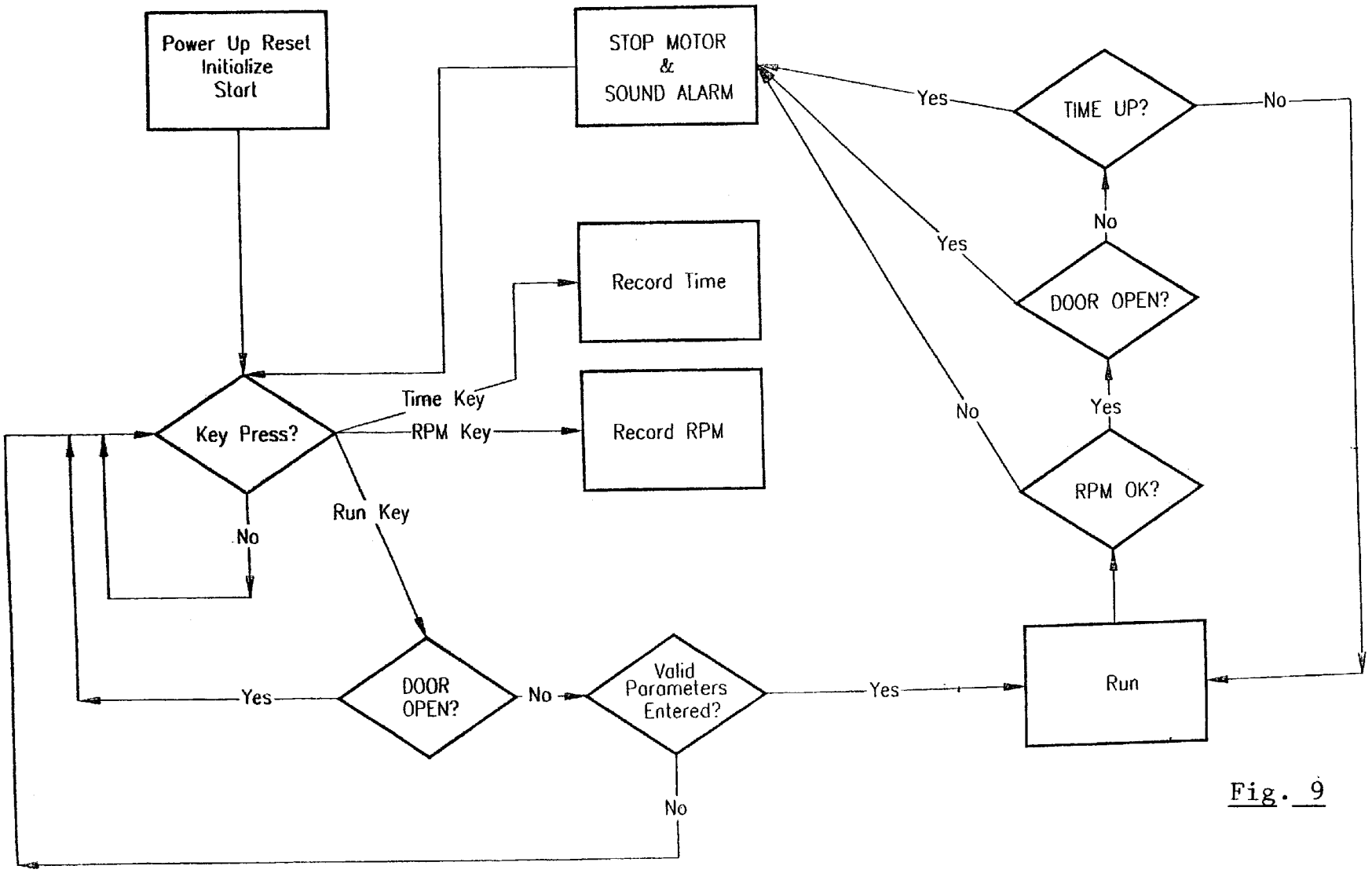
FIG. 9 is a flow chart of the software program run in the control microprocessor, previously seen in FIGS. 8*a* and 8*b*, of the Instrumentation and Processor Controller section, previously seen in FIG. 7, of the shaker in accordance with the present invention, previously seen in FIGS. 1–6.

A flow chart of the software program run in the control microprocessor U3, seen in FIGS. 8*a* and 8*b*, or the Instrumentation and Processor Controller section, seen in FIG. 7, of the shaker 1 in accordance with the present invention is shown in FIG. 9. The control microprocessor U3 executes this software program upon start-up, and continuously thereafter. The program provides for operator input of parameters at the keyboard 77 (shown in FIG. 7) part of control panel 216 (shown in FIG. 6), storage of these parameters in the volatile memory U4 (shown in FIG. 8*b*) and non-volatile memory U9 (shown in FIG. 8*a*), and selective activation of the series wound motor 76 (shown in FIG. 7) part of motor 15 (shown in FIG. 1) and the display 78 (shown in FIG. 7) part of control panel 216 (shown in FIG. 6) including, generically, the indicators 215 of control panel 216 (shown in FIG. 6). The actions diagrammed in the flow chart are self-explanatory.

Accordingly, the best mode presently contemplated for the carrying out of the invention has been described. This description was made for the purpose of illustrating the general principles of the invention, and is not to be taken in a limiting sense. The scope of the invention is best determined by reference to the appended claims.

In fact, and in accordance with the preceding explanation, variations and adaptations of the shaker in accordance with the present invention will suggest themselves to a practitioner of the mechanical design arts. For example, there could be more than two shaker trays or containers supported, each on a separate piston connected to a separate linkage to a separate, angularly staggered, point on a camshaft. In other words, the shaker of the present invention could be expanded from being analogous to a two-cylinder engine to a engine of three, four, or even more cylinders.

In accordance with these and other possible variations and adaptations of the present invention, the scope of the invention should be determined in accordance with the following claims, only, and not solely in accordance with that embodiment within which the invention has been taught.

What is claimed is:

1. A shaker comprising:

a frame;

a motor, mounted to the frame, with a shaft extending from the motor in each of two opposite directions;

two crankshafts, each directly affixed to one directional extension of the shaft at a 180° phase difference;

two pistons constrained for linearly reciprocating movement, a top region of each piston having an engagement feature engaging and retaining to the piston a jig fixture that holds a sample during reciprocating movement of the piston; and two linkages, each directly connecting one of the two crankshafts to a respective piston;

wherein when the motor turns the shaft and also the crankshafts affixed to the shaft then the pistons linearly reciprocate oppositely, one piston being at the apex of its stroke while the other is at the nadir, therein serving to shake any samples that are within any containers that are held within any jig fixtures engaging, and retained upon, the pistons.

2. The shaker according to claim 1 wherein each of the two crankshafts is counter-weighted.

3. The shaker according to claim 1 wherein each of the two crankshafts comprises:

a crank pin;

wherein each linkage connects to its associated crankshaft through its crank pin; and a counterweight to the crank pin and the connected linkage and the linkage-connected piston.

4. The shaker according to claim 1 wherein the engagement feature at the top region of each of the two pistons comprises:

a cylindrical extension having an exterior surface relieved at at least one side of the exterior surface; and a threaded central bore to the shaft.

5. The shaker according to claim 1 further comprising:

two jig fixtures, one mountable to each piston, each jig fixture comprising a grid array holder tailored to hold one or more sample containers of a particular configuration; contained within a box holding the array holder; constrained within a space frame holding and clamping shut the box with the at least one grid array holder and the one or more sample containers held within the box, the space frame having an engagement feature complimentary to the engagement feature of the top region of each piston;

wherein each jig fixture is mountable by its engagement feature to a piston for oscillatory shaking during operation of the shaker.

6. The shaker according to claim 1 wherein the frame comprises:

a base suitable to set upon a bench; and a sub-base for constraining the two pistons for linearly reciprocating movement; suspended above the base by a plurality of springs;

wherein the motor is mounted to the sub-base of the frame.

7. A laboratory shaker comprising:

a frame;

a motor, mounted to the frame, symmetrically balanced by having a shaft extending from the motor in each of two opposite directions;

a counterbalanced crankshaft affixed to each directional extension of the shaft, a crankshaft at one shaft extension being angularly affixed at a 180° phase difference to the crankshaft at the other shaft extension;

two pistons constrained for linearly reciprocating movement, a top region of each piston having engagement features suitable to engage and retain a jig fixture holding a sample for shaking; and a linkage connecting each crankshaft to a respective one of the two pistons;

a jig fixture (i) engaging, and retained upon, each piston and (ii) holding samples within containers;

wherein when the motor turns the shaft and also the crankshafts affixed to the shaft then each piston linearly reciprocates oppositely to the other, one piston being at the apex of its stroke while the other is at the nadir, therein serving to shake any samples that are within any containers that are held within the jig fixtures engaging, and retained upon, the pistons.

8. A programmable shaker comprising:

a frame;

a motor, mounted to the frame, with a shaft extending from the motor in each of two opposite directions, the motor being controllable in rotation of the shaft;

two crankshafts, each affixed to one directional extension of the shaft at a 180° phase difference;

two pistons constrained for linearly reciprocating movement, a top region of each piston having an engagement feature engaging and retaining to the piston a jig fixture that holds a sample during reciprocating movement of the piston; and two linkages, each connecting one of the two crankshafts to a respective piston;

wherein when the motor turns the shaft and also the crankshafts affixed to the shaft then the pistons linearly reciprocate oppositely, one piston being at the apex of its stroke while the other is at the nadir, therein serving to shake any samples that are within any containers that are held within any jig fixtures engaging, and retained upon, the pistons; and a processor controller programmable by a user-operator with multiple different protocols for conducting shaking of samples, and, once programmed, causing that each shaking protocol is thereafter executable and re-executable at times by the motor when the user-operator merely identifies the protocol, without any necessity of re-programming each protocol each time shaking in accordance therewith is accomplished.

* * * * *